US005901568A

United States Patent [19]

Haga

[11] Patent Number: 5,901,568

[45] Date of Patent: May 11, 1999

[54] ROTATING HEAT PUMP

[75] Inventor: Johan Haga, Kolbotn, Norway

[73] Assignee: Haga Engineering AS, Oslo, Norway

[21] Appl. No.: 08/973,836

[22] PCT Filed: Jul. 12, 1996

[86] PCT No.: PCT/NO96/00180

§ 371 Date: Dec. 18, 1997

§ 102(e) Date: Dec. 18, 1997

[87] PCT Pub. No.: WO97/03326

PCT Pub. Date: Jan. 30, 1997

[30] Foreign Application Priority Data

Jul. 13, 1995 [NO] Norway ..... 95 2792

[51] Int. Cl.[6] ..... F25B 13/00

[52] U.S. Cl. ..... 62/324.6; 62/499; 62/504; 62/513; 165/86

[58] Field of Search ..... 62/499, 504, 513, 62/324.1, 324.6, 325; 165/86

[56] References Cited

U.S. PATENT DOCUMENTS

| | | | |
|---|---|---|---|
| 1,871,645 | 8/1932 | Abbott, Jr. . | |
| 3,397,739 | 8/1968 | Miller | 62/499 |
| 3,797,270 | 3/1974 | Laing et al. . | |
| 3,863,454 | 2/1975 | Doerner | 62/499 X |
| 3,911,694 | 10/1975 | Doerner | 62/499 |
| 4,512,394 | 4/1985 | Kauffman . | |
| 4,611,472 | 9/1986 | Lum | 62/499 |
| 5,303,565 | 4/1994 | Pravda | 62/499 X |
| 5,315,844 | 5/1994 | Hansen | 62/499 X |

FOREIGN PATENT DOCUMENTS

| | | |
|---|---|---|
| 0119777 | 9/1984 | European Pat. Off. . |
| 460936 | 6/1928 | Germany . |
| 636012 | 10/1936 | Germany . |
| 42846 | 5/1926 | Norway . |
| 524116 | 7/1972 | Switzerland . |
| WO 86/06156 | 10/1986 | WIPO . |

*Primary Examiner*—Henry Bennett
*Assistant Examiner*—Susanne C. Tinker
*Attorney, Agent, or Firm*—Lynn & Lynn

[57] ABSTRACT

A heat pump with a closed cooling medium circuit for transport of heat from one air flow to another, comprises an evaporator (27) provided in one air flow for evaporation of a cooling medium, a compressor for compression of the vaporiform cooling medium, a condenser (28) provided in the other air flow for condensation of the cooling medium, and a return system for condensed cooling medium from the condenser (28) to the evaporator (27). The evaporator (27), the compressor and the condenser (28) are located in a fan casing (32) and arranged to rotate about a common shaft (1), with the compressor in the middle. The compressor works according to the liquid ring principle and comprises a rotating compressor housing (17), an intermediate shaft (2) mounted eccentrically on the outside of the shaft and one or more free-running impellers (3A, 3B), thus causing the compressor housing (17) to transfer rotary energy to the impellers via the liquid ring during operation. The evaporator (27) and/or the condenser (28) each comprises an outer housing which is equipped with surfaces which project into the air flow, with the result that the evaporator (27) and/or the condenser (28) act as fans.

13 Claims, 6 Drawing Sheets

ROTATING HEAT PUMP

Figure 1A:
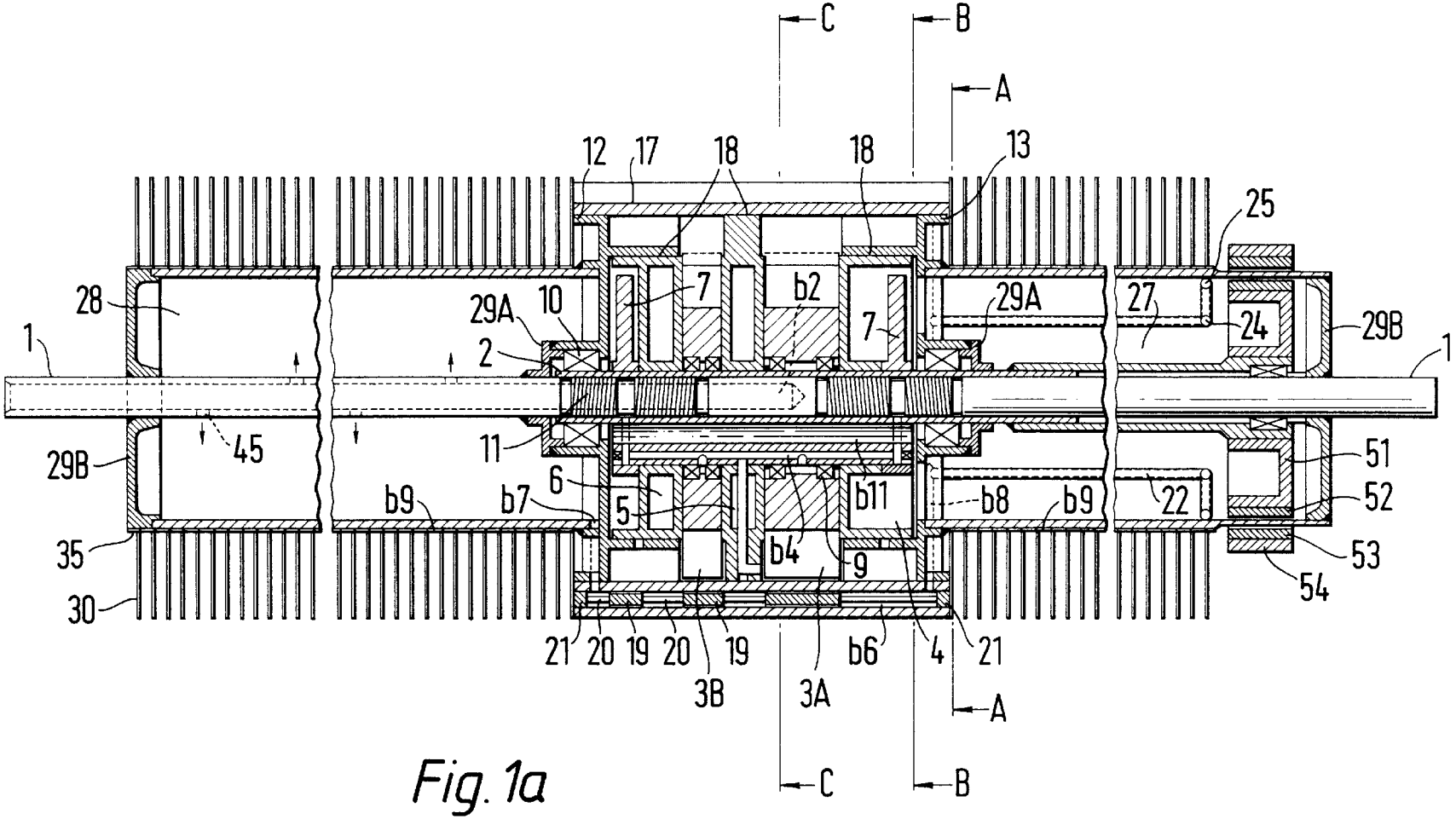

The invention concerns a heat pump with a closed cooling medium circuit for transport of heat from one air flow to another, comprising an evaporator provided in one air flow for evaporation of a cooling medium, a compressor for compression of the vaporiform cooling medium, a condenser provided in the second air flow for condensation of the cooling medium, and a return system for condensed cooling medium from the condenser to the evaporator.

Heat pumps for transfer of heat from one air flow to another are used, amongst other places, in houses, where heat can be transferred from air which is extracted via a ventilation system to air which is drawn in from outside to be discharged inside the house. By means of heat pumps it is also possible to transfer heat from the outdoor air to the indoor air.

Heat pumps work with a liquid cooling medium which is passed between the vapour and the liquid phase, thus permitting heat to be transferred from a colder air flow to a warmer air flow. Current heat pumps work well as long as the air from which the heat is taken is relatively warm, usually over 5–6° C., but the efficiency is reduced as soon as the temperature drops.

U.S. Pat. No. 1,871,645 describes a rotating heat pump comprising a condenser, a liquid ring compressor and an evaporator arranged in a housing. Refrigerant flows to a cooler, in which it is cooled by an air flow. The air is introduced axially, passes the cooler and leaves the heat pump radially.

WO 86/06156 describes a rotating heat pump comprising a condenser, a liquid ring compressor and an evaporator arranged in a housing. An annular chamber constitutes the return passage for the refrigereant from the condenser to the evaporator. Ribs on the external surface of the housing produce an axial airflow past the condenser and/or the evaporator. The axial airflow is transformed into a radial airflow before the air leaves the heat pump.

The object of the invention is to develop completely new heat pump solutions which work efficiently at low outdoor temperatures which, e.g., occur during winter in Scandinavia, and which have a simple design which provides low manufacturing costs, a high degree of reliability and a long working life.

This object is achieved with a heat pump of the type mentioned in the introduction, characterized by the features which are indicated in the claims.

The heat pumps according to the present invention consist in principle of a rotating part, a fan casing which encloses the rotating part, insulation which is placed on the outside of the fan casing in order to insulate against heat loss, the formation of condensation and noise from the rotating part, and an outer casing.

The heat pumps according to the present invention work according to an approximate Carnot process. This is achieved by passing the cooling medium from the condensation stage to the evaporation stage through a return system which comprises one or more tubes or bores which contain separated restrictions, with the result that when the condensed medium flows through it undergoes an expansion and total or partial evaporation after it has passed the restrictions, with subsequent condensation between the restrictions. The restrictions are preferably in the form of plugs with grooves or holes, separated by spacers. During this multi-stage expansion with subsequent condensation the cooling medium gives up enthalpy, and this enthalpy is taken up by an ambient air flow as useful heat.

The compressor works according to the liquid ring principle, but differs from standard liquid ring compressors in that the compressor housing also rotates, preferably with the same number of revolutions as the compressor's impeller, since in the present invention it is the liquid ring which transfers the motive power from the compressor housing to the compressor's impeller. This leads to a high degree of compressor efficiency since no liquid friction is created between liquid ring and compressor housing, as opposed to standard liquid ring compressors with stationary compressor housings where the friction between liquid ring and compressor housing is very high, and the compressor efficiency thereby correspondingly low.

The liquid ring compressor which is employed in the invention is preferably designed without valves, and can be designed for one stage, two or more stages. With, e.g., butane as the cooling medium it is appropriate to provide a compression in two stages.

As the working medium in the liquid ring an oil is used which does not mix with the cooling medium employed, which has greater specific weight than the cooling medium, and which has suitable viscosity at those temperature ranges in which the heat pump is working.

For a conventional liquid ring compressor with stationary compressor housing where the compressor's impeller establishes the liquid ring, the degree of viscosity which the working medium in the liquid ring can have is limited, since due to the friction between liquid ring and compressor housing, the power consumption increases significantly with increasing viscosity. The heat pump according to the present invention on the other hand has a rotating compressor housing, where it is the rotation which establishes the liquid ring, thus permitting an oil with relatively high viscosity to be used as the working medium in the liquid ring without any increase in the power consumption on this account. The advantage of the relatively high viscosity is that a further improvement is obtained in the sealing conditions between the rotating and stationary parts in the compressor part compared to the sealing conditions in a conventional liquid ring compressor.

The heat pump according to the present invention is best suited for small units with a heat output from 1–2 kW and up to approximately 10 kW, and is primarily intended for installation in detached houses, flats in blocks of flats, as well as shops, small business premises and industrial premises, etc., but it can also be employed in a number of other areas such as, e.g., for dehydration of air/gases, heat transfer between two air/gas flows, and, e.g., as a unit in cold-storage rooms, refrigerated display cabinets and drying rooms. They may also be used as pure air conditioning units, e.g. in shops and office premises. Since they are of a compact design, they will also cover a building's requirements for mechanical ventilation in a very economical fashion.

For production reasons all the heat pumps have the same cross section regardless of size, while the length will vary depending on the size. For example, including insulation and the outer casing the cross section will be approximately 306×306 mm for all types, while, e.g., the length for a 2 kW unit will be approximately 900 mm, and for a 4 kW unit approximately 1400 mm.

Further features and advantages of the present invention will be presented in the following description of an embodiment of a rotating heat pump with liquid ring compressor, which is illustrated in the drawing, in which:

FIG. 1*a* is a longitudinal section through the rotating part of the heat pump, i.e. the fan casing, insulation and outer casing are not illustrated.

Figure 1B:
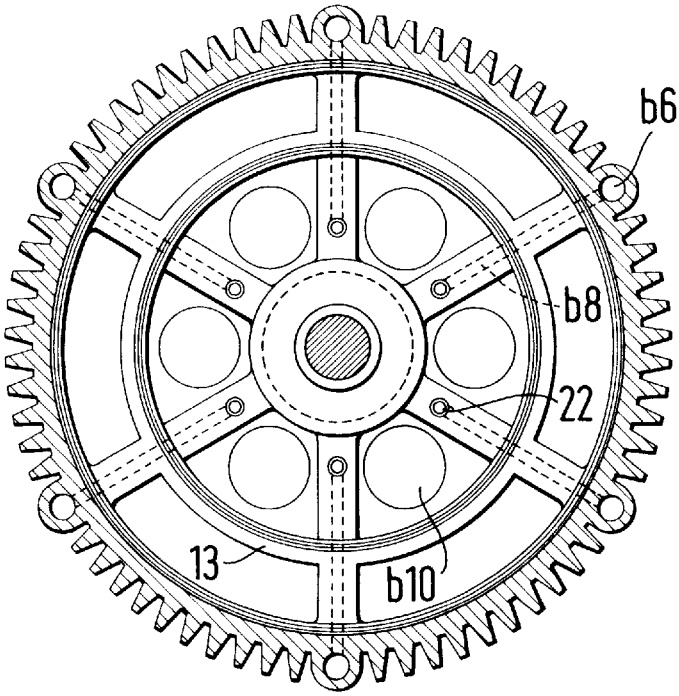

FIG. 1*b* is a cross section A—A through the compressor part.

Figure 1C:
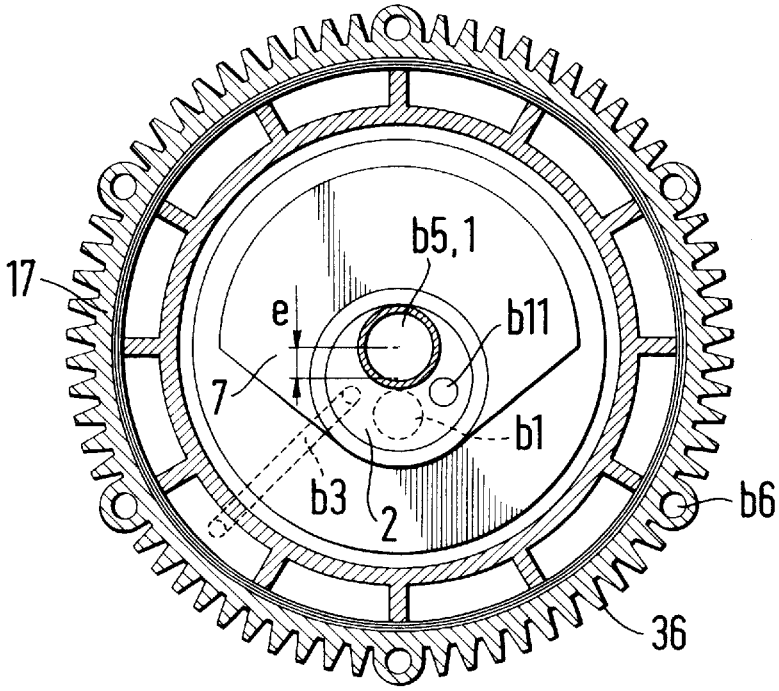

FIG. 1*c* is a cross section B—B through the compressor part.

Figure 1D:
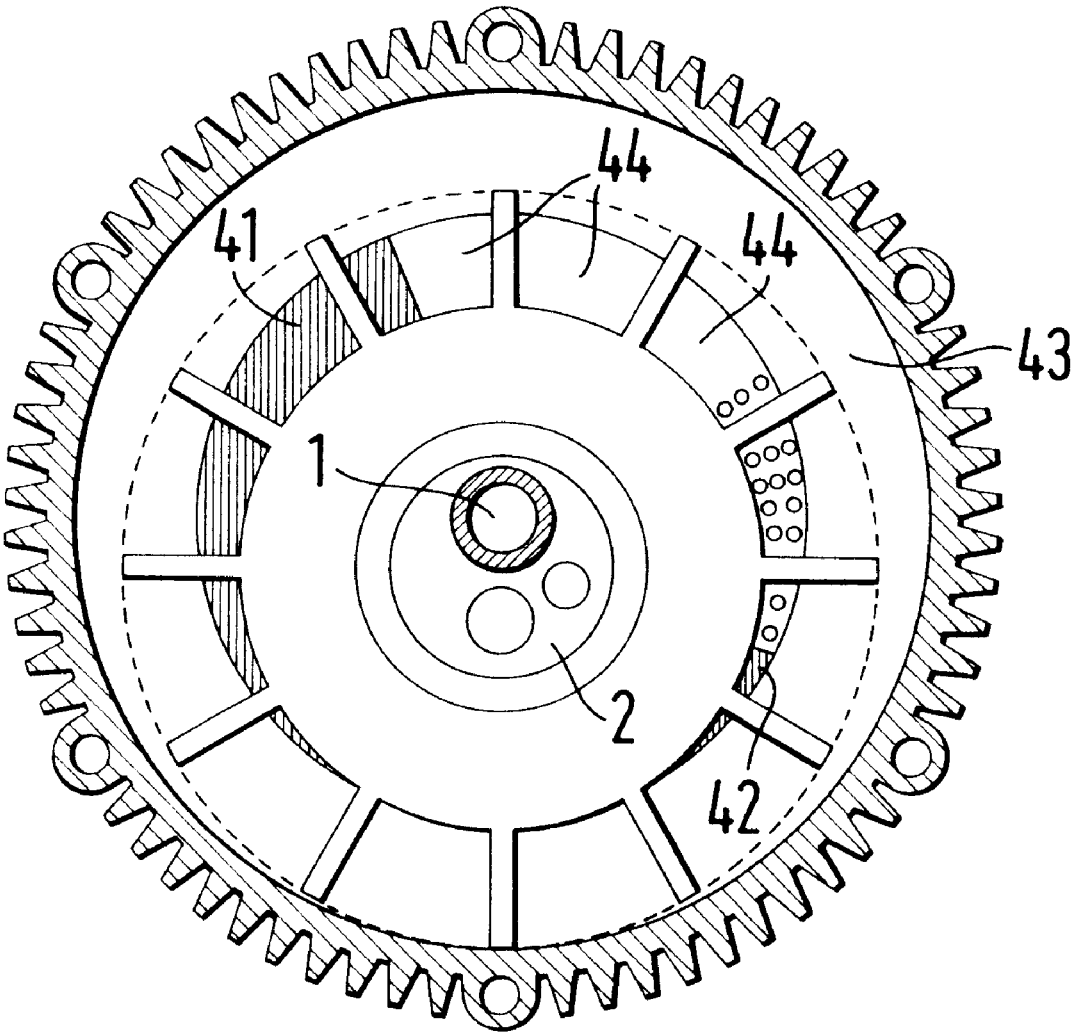

FIG. 1*d* is a cross section C—C through the compressor part.

Figure 2A:
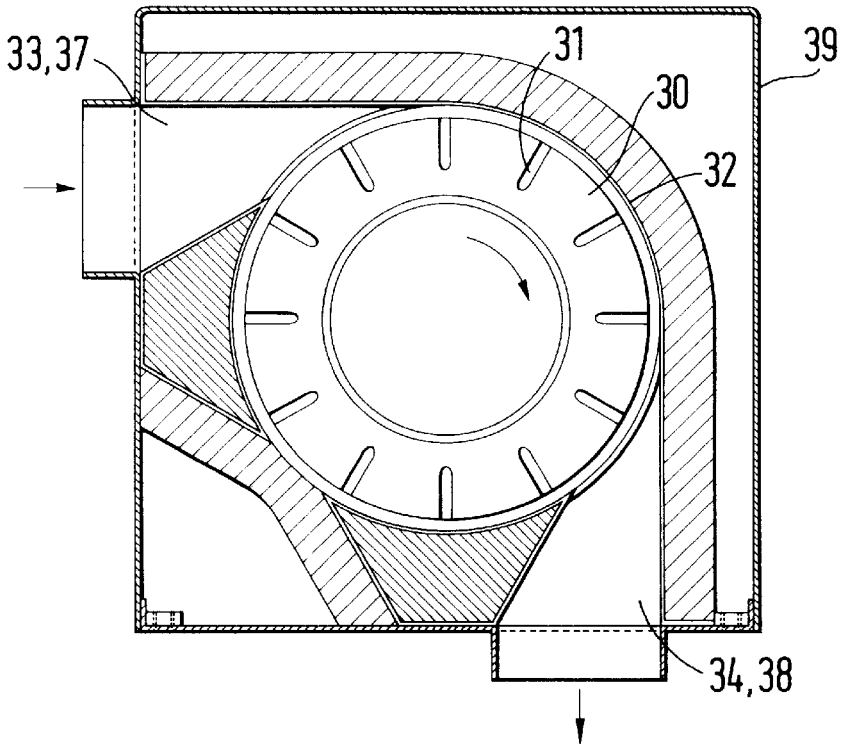

FIGS. 2*a* and *b* are a cross section through evaporator and condenser.

Figure 2B:
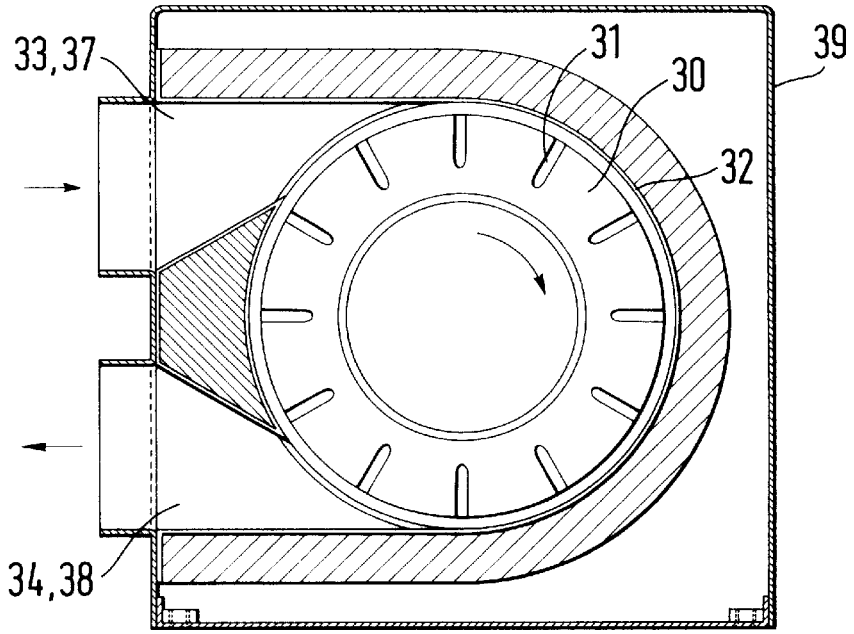
Figure 2C:
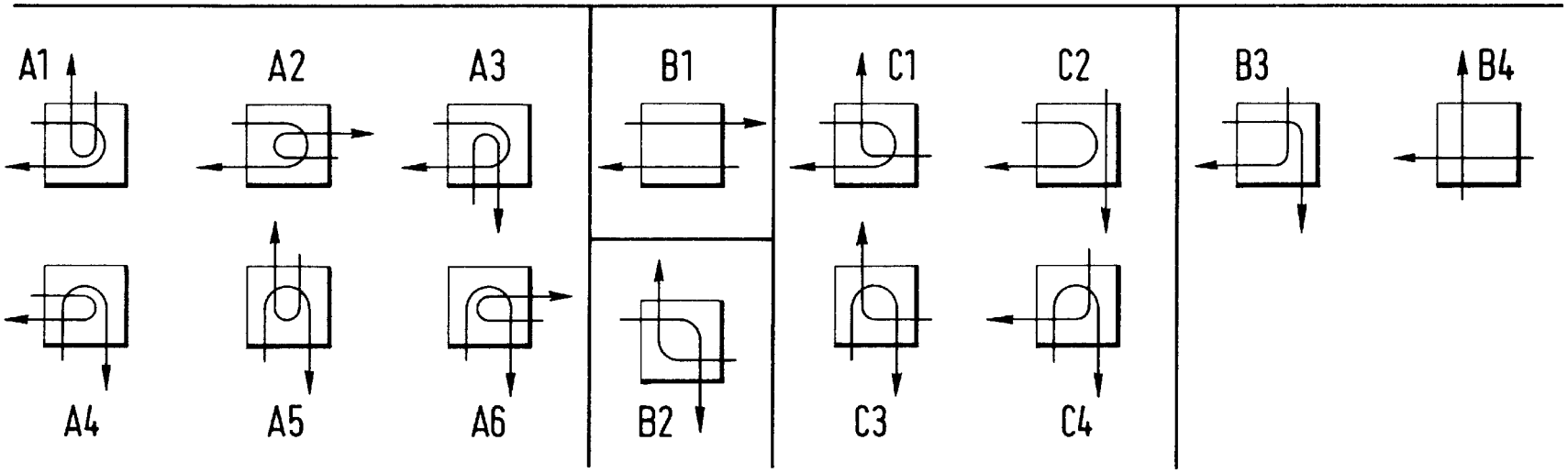

FIG. 2*c* illustrates various alternatives for coupling inlet and outlet connectors to evaporator and condenser.

Figure 3:
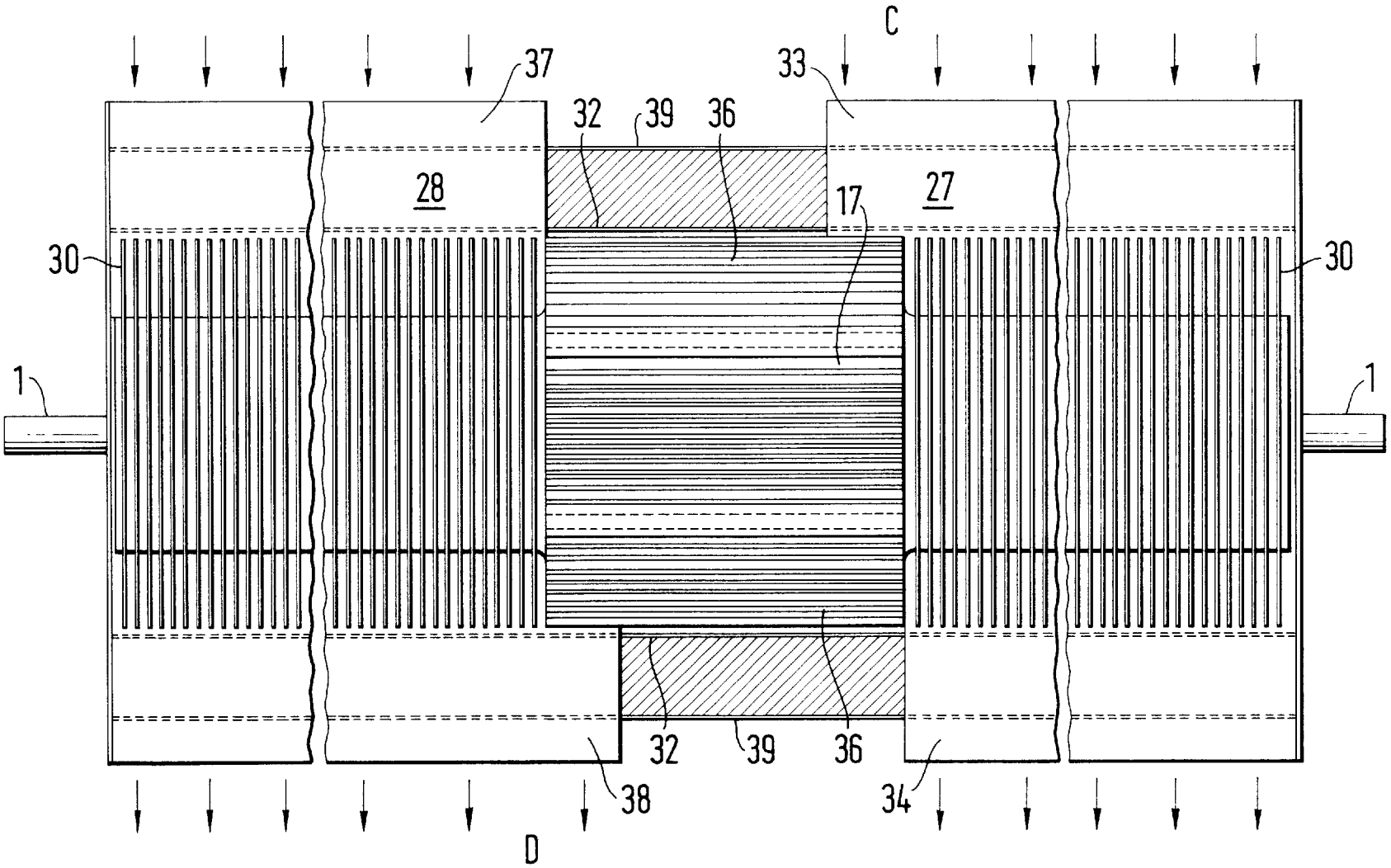

FIG. 3 is a view of a heat pump where the movement of air over evaporator, compressor housing and condenser is illustrated.

The rotating heat pump illustrated in FIG. 1 consists of a central through-going shaft 1, driven by a motor which is not shown and which is permanently installed and forms a mounting for the evaporator part 27, the compressor part, indicated by its housing 17, and the condenser part 28. The compressor's impeller is mounted by ball bearings 9 on an intermediate shaft 2, thus allowing the impellers to rotate freely about the centre of the intermediate shaft. The number of impellers is determined by the number of compression stages to be used. In the embodiment illustrated in FIG. 1 a two-stage compression is shown, with two impellers 3A and 3B.

The heat pump is filled with a cooling medium, which may be butane, and a working medium in the form of an oil which does not mix with the cooling medium, which has greater specific weight than the cooling medium and which has a suitable viscosity.

When the compressor is in operation the housing 17 rotates, drawing the working medium along in the rotation, with the result that, due to the centrifugal force, the working medium forms a liquid ring 43, which in turn draws the impellers along during the rotation. The impellers consist of a hub with radial wings, which together with the liquid ring will define closed spaces 44. The centre of the intermediate shaft 2 is displaced by a distance e from the centre of the shaft 1, and provided that the intermediate shaft 2 rotates at a different speed from the impellers 3A, 3B, the impellers will rotate eccentrically about the shaft 1, with the result that the closed spaces 44 vary in size as the impellers rotate. This variation in size of the closed spaces 44 generates forces which attempt to compress cooling medium which is located in the space, while at the same time the forces also attempt to cause the intermediate shaft 2 to rotate at the same speed as the impellers, i.e. the same speed as the compressor housing and the shaft 1. Thus it is possible to alter the compressor's capacity, and thereby the heat pump's capacity, by altering the intermediate shaft's speed, which will be discussed in more detail later. In the following description of the heat pump's mode of operation it should be assumed that the intermediate shaft is at rest or rotates at a different speed from the impellers.

On the intermediate shaft 2, on each side of the impellers 3A, 3B, there are permanently mounted closed annular chambers 4, 5, 6 which form reservoirs for the cooling medium vapour during the compression. The annular chambers 4, 5, 6 are provided on each side with port openings 41, 42 which form inlets to and outlets from the individual impellers. Annular chamber 4 will contain cooling medium vapour with vapour pressure corresponding to the evaporator pressure, annular chamber 5 will contain cooling medium vapour with vapour pressure which is formed after the first stage compression, and annular chamber 6 will contain cooling medium vapour with vapour pressure which is formed after the second stage compression. The compressed cooling medium vapour flows from annular chamber 6 through a not shown radially provided outlet to an axial bore b1 in the intermediate shaft 2, through a radial bore b2 in the shaft 1, on through an axial bore in the shaft 1 and out through radial openings 45 in the shaft 1, to condensation in the condenser 28. On each side of the radial bore b2 seals 11 are provided between sealing surfaces on the shaft 1 and the intermediate shaft 2.

The intermediate shaft 2 consists of an eccentric central section and a centric part at each end, mounted in ball bearings 10. At each end of the intermediate shaft 2 on the eccentric part there is a permanently mounted counterweight 7. The counterweight 7 balances the laterally directed forces which act on the intermediate shaft due to the eccentric rotation of the impellers.

The annular chamber 5 has a radial tube b3 whose inlet is submerged in the liquid ring. During the rotation, due to overpressure in the liquid ring, oil from the liquid ring will be passed into the radial tube b3 through an axial bore b4 in the intermediate shaft 2, and on to lubrication of the ball bearings 9 and 10. Similarly oil from the liquid ring will be passed to the contact-free seals 11, where the oil acts as seal oil.

The intermediate shaft 2 has an axial bore b5 which forms a passage for the through-going shaft 1. The contact-free seals 11 are produced by providing on each side of a cylindrical section on the shaft 1 which forms the inlet for the seal oil helical grooves in the shaft 1 with direction of pitch adapted to the direction of rotation. As the stationary intermediate shaft 2 and the rotating shaft 1 rotate about each other the grooves will generate a thrust which forces oil against the gas pressure against which the seal is intended to act, and together with the grooves this thrust will prevent leakage of gas through the seals.

In order to equalize any pressure difference between the compressor part's two end surfaces, and thereby eliminate axial forces on the compressor part, there is provided in the intermediate shaft 2 an axial, through-going bore b11.

The ball bearings 10 at each end of the intermediate shaft 2 are mounted in an end gable 12 against the condenser and an end gable 13 against the evaporator. The end gable 12 forms a watertight wall between the condenser and the compressor part, while the end gable 13 has 6 openings b10 which form inlets from the evaporator to the compressor part. Two covers 29 A form the termination of the compressor part against the evaporator and the condenser respectively, and are welded to the end gables 12 and 13. The cover 29 A against the condenser is also welded to the shaft 1 after it has been passed into place through the bore b5 in the intermediate shaft 2.

The three annular chambers 4, 5, 6 have an external diameter which is slightly larger than the internal diameter of the liquid ring, with the result that the three annular chambers project slightly into the liquid ring. Between the compressor housing 17 and annular chamber 5, between end gable 12 and annular chamber 6 and between and gable 13 and annular chamber 4, there are formed slits which constitute contact-free gap seals 18, where one sealing surface is provided with helical grooves whose direction of pitch is adapted to the direction of rotation. When the slits are submerged in oil, a thrust will be generated between the stationary annular chambers and the rotating compressor housing, which thrust presses the oil against the pressure against which the seals are intended to act, and which together with the grooves will prevent an overflow of oil from a zone with higher pressure to a zone with lower pressure in the liquid ring.

During the compression the compression heat will be very rapidly transferred to the liquid ring. In a conventional liquid ring compressor with stationary compressor housing the compression heat is removed as new and cooled liquid is constantly added to the liquid ring.

In the present invention the compression heat is removed due to the fact that the rotating compressor housing 17 has cooling fins 36 on the outside and is cooled by air. The cooling fins 36 can either be provided as radial, helical or axial cooling fins. For production reasons the cooling fins 36 should preferably be axial as illustrated in FIGS. 1 and 3. With axial cooling fins 36, see FIG. 3, the cooling air flows in over the compressor housing 17 at the end which abuts against the evaporator 27, indicated by C. The air intake is perpendicular to the heat pump's longitudinal axis, and takes place in the extension of the air intake 33 to the evaporator 27. When the heat pump rotates the cooling air over the compressor housing 17 will receive a helical movement towards the end of the compressor housing 17 which abuts against the condenser 28, whereupon the cooling air goes out perpendicularly to the heat pump's longitudinal axis, together with hot air from the condenser 28 in the extension of the air outlet 38 from the condenser 28, indicated by D.

In addition to the axial cooling fins 36 there are also provided in the compressor housing 17 six axial bores b6 diametrically located above one another, as illustrated in FIG. 1. In each of the six bores there are located at least two separated restrictions in the form of plugs 19, separated by spacers 20. The outer surface of the plugs is provided with grooves, which can either be helical or axially linear. The length of the plugs 19 together with the depth of the grooves and the number of grooves in the individual plugs 19 can vary. The spacers 20 have a smaller diameter than the plugs 19, with the result that between each of the plugs 19 there is formed an annular cavity, and the length of the spacers 20 and thereby also the length of the annular cavity created can vary.

At each end the six bores b6 have an end plug 21 which forms a gas-tight seal of the bores b6 against the atmosphere. In a circular flange on the end gable 12 there are provided six radial holes b7 which form a passage from the condenser to the annular cavities in the bores b6. Similarly there are provided in the end gable 13 six radial bores b8 which run from the annular cavity in the bores b6 towards the heat pump's centre axis to six axially located tubes 22. The tubes 22 are anchored at one end to the end gable 13, and at the other end, inside the evaporator 27, provided with a 90 degree bend 24 which ends in nozzles 25 with outlet in a plane perpendicular to the heat pump's centre axis, directed towards the heat pump's direction of rotation (not shown in FIG. 1).

The bores b7, b6 with the plugs 19, spacers 20, bores b8, tubes 22, bends 24 and nozzles 25 form the return system for cooling medium condensate from the condenser 28 to the evaporator 27. In FIG. 1 there are illustrated six return systems, but the number may be more or less depending on the size of the heat pump. However, the return systems must be provided in such a manner along the circumference of the compressor housing 17 that they do not create an imbalance and additional mechanical forces due to the rotation.

According to the prior art the cooling medium in the cooling processes is brought from a state under high pressure in the condenser to a state under low pressure in the evaporator. By means of a Carnot process, which theoretically is the best process which can be achieved, and which is considered to be unattainable in practice, during this lowering of pressure the cooling medium gives up its enthalpy as useful work. In known, practical cooling processes, however, this enthalpy difference is not given up as useful work, but is released during expansion and evaporation of the cooling medium as the cooling medium passes a choke valve at the inlet to the evaporator. Compared to a Carnot process the cooling medium hereby obtains a reduced capacity to absorb heat in the evaporator, and the efficiency becomes correspondingly lower than what it could have been if it had been possible to produce a cooling process which acted as a Carnot process.

With the heating pump according to the invention most of the enthalpy difference between the state of the cooling medium in the condenser and the evaporator is removed since the cooling medium undergoes a multi-stage expansion and condensation in the return system.

In its passage through the grooves in one of the plugs 19 the cooling medium condensate undergoes a lowering of pressure, thus causing it to expand and evaporate. The cooling medium vapour which is formed has a higher temperature than the plug 19 and the walls in the bore b6, which results in enthalpy in the form of heat being given up from the cooling medium vapour to the walls, and on to the compressor's housing. This emission of enthalpy in turn results in the cooling medium vapour condensing in the cavity behind the plug, and returning to condensate. The cooling medium has thereby undergone one stage in the multi-stage expansion and condensation.

The condensate flows on in the return system, expands and evaporates once again as it passes through the grooves in the next plug, condenses again in the cavity behind the plug, and continues in this manner until at the end of the bore b6 it has undergone a multi-stage expansion and condensation.

The enthalpy difference is passed from the compressor's housing to an ambient air flow as useful heat.

Due to the fact that enthalpy is given up in the return system the heat uptake in the evaporator is optimized since the cooling medium will flow into the evaporator in liquid form without the occurrence of any evaporation during the influx.

The flow through bore b6 is two-phased since the rotation separates gas and liquid due to the difference in specific weight, and will take place the whole time during cooling with the same cooling air from the extended air inlet 33 which passes over compressor housing 17 and removes heat from the compressor's liquid ring, i.e. the enthalpy difference between the condenser's and the evaporator's condensate is transferred as heat to the same cooling air which cools the liquid ring, and leaves the heat pump as hot air together with the rest of the hot air from the condenser through the extended air outlet 38, and continues to be used for heating purposes.

The illustrated plugs 19 with the spacers 20 are a preferred embodiment of separated restrictions in order to provide a multi-stage expansion with subsequent condensation of the cooling medium during its flow from the condenser to the evaporator, but it is obvious that a number of other designs of these separated restrictions are also possible. For example the plugs 19 can have holes instead of external grooves, or separated narrowings in the actual bores b6 can replace the plugs and the distance pieces.

After the condensate has passed through the bores b6 the cooled condensate passes through the radial bores b8 where it receives an additional lowering of pressure and cooling when it meets the centrifugal field created by the rotation, and is then led into the axially located tube 22 in the evaporator 27 where the condensate emits further heat to the surrounding cooling medium vapour in the evaporator. The directions of flow of the cooling medium in the tubes 22 is turned via a 90 degree bend to directions perpendicular to the heat pump's centre axis, whereupon the cooling medium flows out through nozzles 25 oppositely directed to the heat pump's direction of rotation, with the result that any reaction force from the outflow can also help to reduce the amount of energy necessary to maintain the rotation of the heat pump.

The evaporator 27 and the condenser 28 are each made of aluminium tubes which preferably have the same diameter, but different lengths. In both the evaporator tube 27 and the condenser tube 28 the end which faces the compressor part is smoothed for welding to the end gables 12 and 13. At the opposite end they are welded to the circular end covers 29 B.

During mounting the evaporator tube 27 with the end cover 29 B, and the condenser tube 28 with the end cover 29 B are each passed in over the shaft 1 from its own side to abutment against the end gables 12 and 13. The evaporator tube 27 is welded with a circumferential weld seam against the end gable 13 at one end, and with a circumferential weld seam between the end cover 29 B and the shaft 1 at the other end. In the same manner the condenser tube 28 is welded with a circumferential weld seam against the end gable 12 at one end, and with a circumferential weld seam between the end cover 29 B and the shaft 1 at the other end.

FIGS. 2*a* and *b* are radial cross sections through the evaporator and the condenser, with the fan casing, insulation and outer casing also illustrated. The inlet and outlet connectors for the air for evaporator and condenser are illustrated at an angle of 270° and 360° to each other, but it is clear that a number of other configurations are also possible. With different combinations of inlet connectors for evaporator and condenser the heat pumps will be able to cover all possible installation alternatives, some of which are illustrated in FIG. 2*c*.

FIG. 3 is a view of the heat pump where the inlet and outlet connectors are provided at an angle of 180° to each other both for evaporator and condenser.

Both evaporator and condenser are equipped with circular fins 30 as illustrated in FIGS. 1, 2, and 3, where in a preferred embodiment grooves 31 are pressed in the fins, with the result that in combination with the circular fan casing 32, and the tangential position of air inlet 33 and air outlet 34 for the evaporator 27, or air inlet 37 and air outlet 38 for the condenser 28, illustrated in FIGS. 2*a* and *b*, they create a fan function which transports air over the evaporator and the condenser respectively when the heat pump rotates. Thus separate fans are not necessary for transport of air over the evaporator and condenser, as is required with conventional heat pumps with stationary heat exchangers.

This fan function arises as a result of the fact that the air in the fan casing 32 is set in vigorously circulating motion when the evaporator 27 and the condenser 28 with the fins 30 and the pressed grooves 31 rotate.

The energy per mass unit which the air receives will consist of three parts, viz.:

1. An increase in kinetic energy when the air is set in vigorous circulation. This must be converted to potential energy in the air outlet 34 from the evaporator 27 or in the air outlet 38 from the condenser 28.
2. An increase in potential energy due to the centrifugal field when the air is set in vigorous circulation.
3. An increase in potential energy due to changes in relative speeds.

Since the air goes in and out of the circulating field, the contribution from points 2 and 3 are less than the contribution from point 1. The air flow over the evaporator 27 and the condenser 28 with the circular fins 30 and the grooves 31 is substantially two-dimensional, which gives less air noise than the three-dimensional flow which normally occurs with conventional fan systems. The grooves 31 on the circular fins 30 may have different shapes, and thus they can either be, e.g., bent forward, bent backward or straight radial as illustrated in FIGS. 2*a* and *b*. When the circular fins 30 rotate at high speed ice and frost particles will not build up on the fins and straight radial grooves are therefore considered to be the most favourable design.

The number and length of the grooves on each of the circular fins 30 can vary, while the depth of the grooves will be slightly less than the distance between two neighbouring fins.

FIG. 1 illustrates how the circular fins 30 are attached to the evaporator tube 27 and the condenser tube 28. The circular fins 30 have a flanged section 35 which abuts against the evaporator tube 27 and the condenser tube 28. The flanged section 35 has holes b9 located along the circumference as illustrated in FIG. 1. The circular fins 30 with the flanged part 35 are shrunk on to the evaporator tube 27 and the condenser tube 28, and secured mechanically by filling weld deposit in the holes b9 on the flanged part 35. The flanged part 35 provides a large contact surface with good heat transmission conditions, ensures equal spacing between the circular fins 30 and provides a good mechanical attachment for the circular fins 30 on the evaporator/condenser tubes.

At each end of the shaft 1 the rotating part of the heat pump is provided with two ball bearings (not shown) which in turn are mounted in end gables in the fan casing 32. The shaft is driven directly via a not shown coupling by a not shown electrical motor located on the condenser side. The air passage for cooling air over the motor is provided in such a manner that, after having taken up the motor heat, the cooling air enters the air outlet 38 from the condenser, and is mixed with the hot air therefrom, the motor heat thus also being exploited for heating purposes (not shown).

The capacity of the rotating heat pumps according to the present invention can be regulated by altering the speed of the motor, which in principle can be performed in three different ways:

a) On/off regulation, i.e. manual operation of the heat pump.
b) Pole reversible motor controlled by room thermostat.
c) Continuous alteration of the speed with voltage regulation or frequency conversion controlled by room thermostat, which provides the highest annual heat factor of the three methods.

Capacity regulation can also be performed by regulating the rotation speed of the intermediate shaft. As mentioned, during the compression the free-running impellers 3A, 3B will attempt to cause the intermediate shaft 2 to rotate at the same speed as the compressor housing 17 and the shaft 1. Maximum compression is therefore achieved when the intermediate shaft is kept at rest, and no compression is achieved when the intermediate shaft rotates freely at the same rotational speed as the compressor housing and the shaft.

When the compression is disconnected as a result of the capacity regulation, on account of the higher pressure in the condenser the cooling medium vapour will attempt to flow back through the compressor to the evaporator.

In order to prevent this non-return devices can be installed in the cooling medium vapour's flow circuit (not shown in the drawing).

The non-return devices can be in the form of elastic sleeves or stockings placed on the outside of the condenser's outlet openings 45. During compression of the cooling medium vapour an elastic stocking of this kind will be lifted from the shaft 1 and admit cooling medium vapour into the condenser through the openings 45. When compression ceases the stocking will cover the outside of the shaft 1 and prevent backflow of cooling medium vapour.

The non-return devices can also be in the form of non-return valves located inside the axial bore in the shaft 1, either as separate non-return valves or integrated into the actual shaft.

In the version illustrated in FIG. 1 the intermediate shaft 2 is extended inside the evaporator 27 for the attachment of magnetic or magnetizable sections internally located in relation to the evaporator or the condenser. In the embodiment illustrated in FIG. 1 these magnetic or magnetizable sections are designed as a permanent magnetic ring 52, which is attached to a hub 51 which in turn is attached to the extension of the intermediate shaft. An external, stationary, adjustable magnetic field, generated by a permanent magnetic ring 53, forms together with the internal permanent magnetic ring 52 a magnetic coupling which attempts to hold on to the internal permanent magnetic ring 52, and thereby the intermediate shaft 2.

The magnetic coupling between the internal and external magnets generates a holding moment which will keep the intermediate shaft at rest as long as the torque which the impellers exerts on the intermediate shaft is lower than the holding moment. By regulating the magnetic coupling and thereby the holding moment it is thus possible to regulate the compression conditions in the compressor and thereby the heat pump's capacity.

The magnetic coupling can be regulated by attaching the external permanent magnetic ring 53 in an axially displaceable, non-rotatable holder 54, since an axial displacement of the external permanent magnetic ring 53 will increase the distance between the internal and the external permanent magnetic ring in such a manner that the resulting magnetic field is weakened.

The magnetic coupling can also be regulated if the external, stationary, adjustable magnetic field is an electromagnetically adjustable field.

In the above the invention is described with reference to a specific embodiment, which should not be perceived as limiting, since a number of variations of the invention are possible within the frame of the claims. These variations may, for example, be associated with the design of the fan and cooling fins, the number of compressor stages or the regulation of the rotation speed of the intermediate shaft, since, for example, in a simpler embodiment the internal permanent magnetic ring can be replaced by a ring with segments of magnetizable soft iron.

I claim:

1. A heat pump with a closed cooling medium circuit for transport of heat from one air flow to another, comprising an evaporator (27) provided in one air flow for evaporation of a cooling medium, a compressor for compression of the evaporated cooling medium, a condenser (28) provided in the other air flow for condensation of the cooling medium, and a return system for condensed cooling medium from the condenser (28) to the evaporator (27), wherein the evaporator (27), the compressor and the condenser (28) are located in a fan casing (32) and arranged to rotate about a common shaft (1), with the compressor in the middle, wherein the compressor works according to the liquid ring principle and comprises a rotating compressor housing (17), an intermediate shaft mounted eccentrically with respect to the axis of rotation of the compressor housing (2) and one or more free-running impellers (3A, 3B) on the outside of the intermediate shaft (2), thus causing the compressor housing (17) to transfer rotary energy to the impellers via a liquid ring contained between the housing and the impellers during operation, wherein at least one of the evaporator (27) and the condenser (28) comprises an outer housing which is equipped with surfaces which project into the air flow, the evaporator (27) and/or the condenser (28) thereby acting as fans, characterized in that the eccentrically mounted intermediate shaft (2) is mounted on the outside of the shaft (1), and that the return system comprises one or more tubes or bores (b6) in the compressor housing (17), containing separate restrictions, thus causing the condensed cooling medium to undergo a pressure reduction and total or partial evaporation as it flows through after having passed the restrictions, with, due to the higher temperature of the cooling medium, subsequent heat transfer from the evaporated cooling medium to the compressor housing (17), causing condensation of the cooling medium between the restrictions.

2. A heat pump according to claim 1, characterized in that the restrictions are composed of plugs (19) with grooves or holes, and that the plugs are separated by spacers (20).

3. A heat pump according to one of the preceding claims, characterized in that the compressor housing ( 17) has helical, axial or radial cooling fins (36) for the emission of heat from the liquid ring and the return system to an ambient air flow.

4. A heat pump according to one of claims 1 or 2, characterized in that the fan casing (32) is provided with tangential air inlets (33, 37) and air outlets (34, 38).

5. A heat pump according to claim 4, characterized in that the projecting surfaces of the outer housing of at least one of the evaporator (27) and the condenser (28) are designed to produce a two-dimensional air flow in a plane perpendicular to the shaft (1).

6. A heat pump according to claim 5, characterized in that at least one of the evaporator (27) and the condenser (28) comprises an outer housing with circumferential, radial fins (30), possibly with grooves (31) projecting from the fins, to produce a two-dimensional air flow in a plane perpendicular to the shaft (1).

7. A heat pump according to claim 6, characterized in that the fan casing (32) is designed without physical divisions between the air flows around the evaporator (27), the compressor and the condenser (28).

8. A heat pump according to claim 7 characterized in that the evaporator's and the condenser's air inlets (33, 37) are funnel-shaped, and that the evaporator's and the condenser's air outlets (34, 38) are in the form of diffusers.

9. A heat pump according to claim 8, characterized in that the evaporator's air inlet (33) is combined with the air inlet for the compressor, and that the condenser's air outlet (38) is combined with the air outlet for the compressor.

10. A heat pump according to claim 9, characterized in that the compressor housing's cooling fins (36) are designed to lead air from the evaporator's (27) ambient air flow to the condenser's (28) ambient air flow.

11. A heat pump according to claim 10, characterized in that the compressor has liquid-filled seals (11, 18) between sealing surfaces on the shaft (1) and at least one of the intermediate shaft (2) and between sealing surfaces on annular chambers (4, 5, 6) and at least one of the compressor housing (17) and the end gables (12, 13), and optionally channels for leading liquid from the liquid ring to the seals.

12. A heat pump according to claim 11, characterized in that at least one of the seals' (11, 18) sealing surfaces is designed with helical grooves in order to force oil against the gas pressure against which the seal is intended to act when the sealing surfaces are rotated in relation to one another.

13. A heat pump according to claim 12, characterized in that the intermediate shaft (2) has a through-going bore (b11) for equalization of axial pressure which acts on bearings (10) provided at each end of the compressor.

* * * * *